US010307004B1

(12) United States Patent
Lilley

(10) Patent No.: US 10,307,004 B1
(45) Date of Patent: Jun. 4, 2019

(54) STRAW COVER

(71) Applicant: Delia Lilley, Arlington, WA (US)

(72) Inventor: Delia Lilley, Arlington, WA (US)

( * ) Notice: Subject to any disclaimer, the term of this patent is extended or adjusted under 35 U.S.C. 154(b) by 330 days.

(21) Appl. No.: 15/284,707

(22) Filed: Oct. 4, 2016

(51) Int. Cl.
*D03D 3/02* (2006.01)
*A47G 19/30* (2006.01)

(52) U.S. Cl.
CPC ..... *A47G 19/30* (2013.01); *D03D 3/02* (2013.01)

(58) Field of Classification Search
CPC ..... A47G 21/18; A47G 19/30; B65D 77/28; D03D 3/02
USPC ..... 428/36.1; 239/33; 220/705
See application file for complete search history.

(56) References Cited

U.S. PATENT DOCUMENTS 1,735,144 A * 11/1929 Tanner ..... A47G 19/2222 215/391
D400,100 S 10/1998 Minard
6,978,918 B2 12/2005 Scanlan
8,376,246 B2 2/2013 White
2007/0112822 A1 1/2007 Bellamy-Noseworthy
2007/0252048 A1 11/2007 Ivie
2010/0012668 A1 1/2010 Hong
2015/0305528 A1 10/2015 Chen

FOREIGN PATENT DOCUMENTS

WO 03051155 A1 6/2003

* cited by examiner

*Primary Examiner* — Elizabeth M Cole
*Assistant Examiner* — Elizabeth M Imani
(74) *Attorney, Agent, or Firm* — Kyle A. Fletcher, Esq.

(57) ABSTRACT

The straw cover is a device that attaches to a beverage container. The straw cover is a protective cover that can be placed over a drinking straw that is placed within the beverage container. The cover protects the drinking straw while the contents stored within the beverage container are not being consumed. The straw cover comprises a cover, a band, and a seam. The band attaches the straw cover to the beverage container. The cover is placed over the drinking straw. The seam attaches the cover to the band.

15 Claims, 5 Drawing Sheets

STRAW COVER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including kitchen equipment, more specifically, a miscellaneous hand instrument for preparing or storing beverages.

SUMMARY OF INVENTION

The straw cover is a device that attaches to a beverage container. The straw cover is a protective cover that can be placed over a drinking straw that is placed within the beverage container. The cover protects the drinking straw while the contents stored within the beverage container are not being consumed. The straw cover comprises a cover, a band, and a seam. The band attaches the straw cover to the beverage container. The cover is placed over the drinking straw. The seam attaches the cover to the band.

These together with additional objects, features and advantages of the straw cover will be readily apparent to those of ordinary skill in the art upon reading the following detailed description of the presently preferred, but nonetheless illustrative, embodiments when taken in conjunction with the accompanying drawings.

In this respect, before explaining the current embodiments of the straw cover in detail, it is to be understood that the straw cover is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the straw cover.

It is therefore important that the claims be regarded as including such equivalent construction insofar as they do not depart from the spirit and scope of the straw cover. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
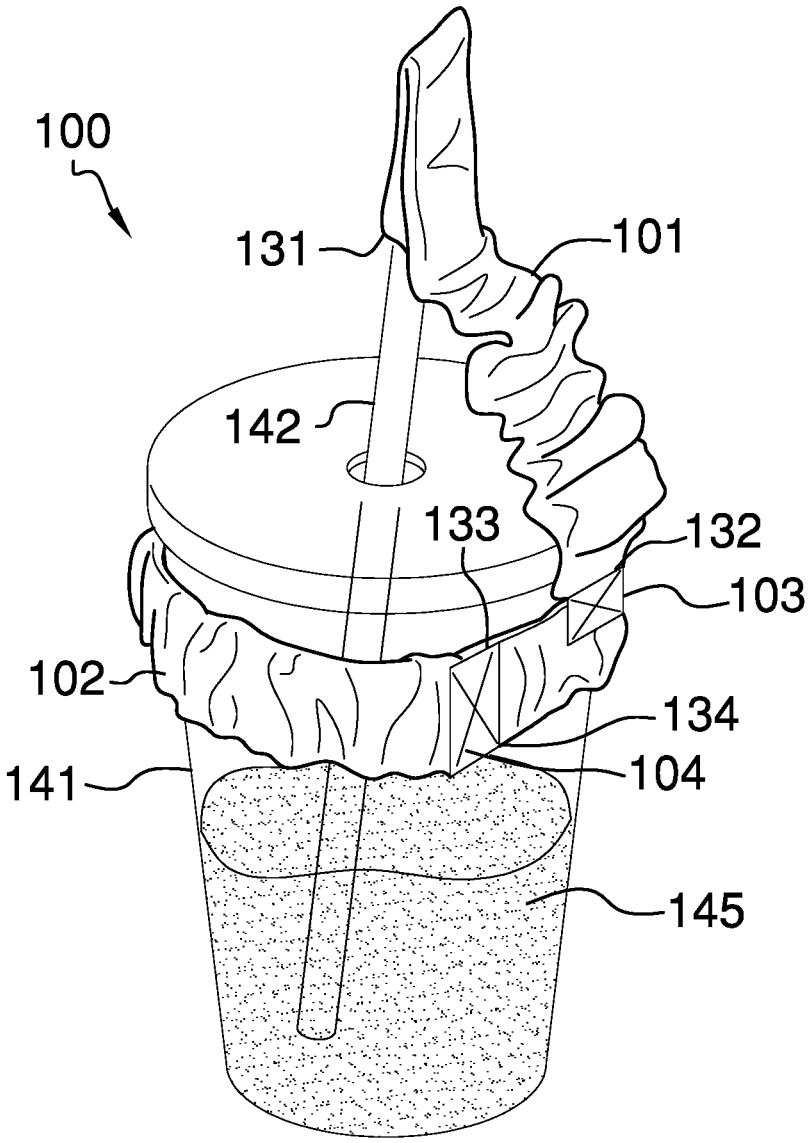
FIG. 1 is an in use view of an embodiment of the disclosure.
Figure 2:
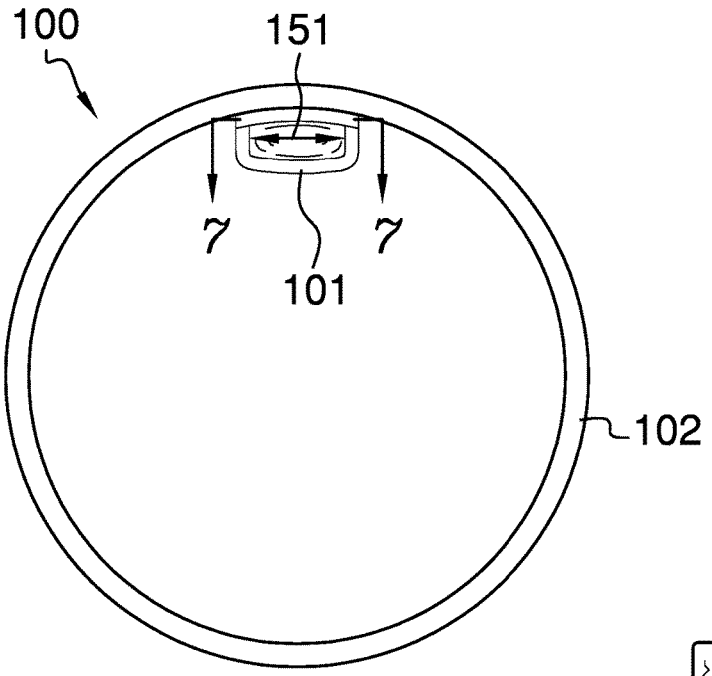
FIG. 2 is a bottom view of an embodiment of the disclosure.
Figure 3:
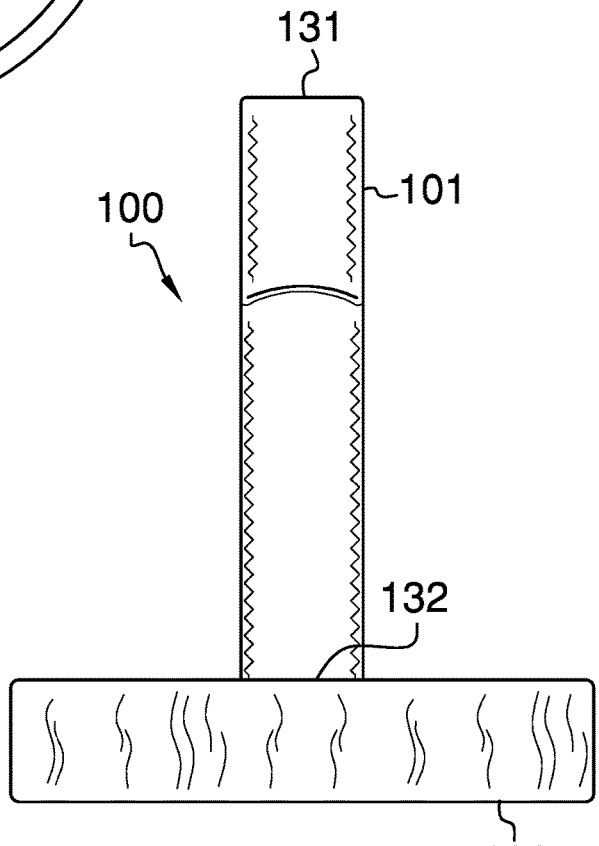
FIG. 3 is a front view of an embodiment of the disclosure.
Figure 4:
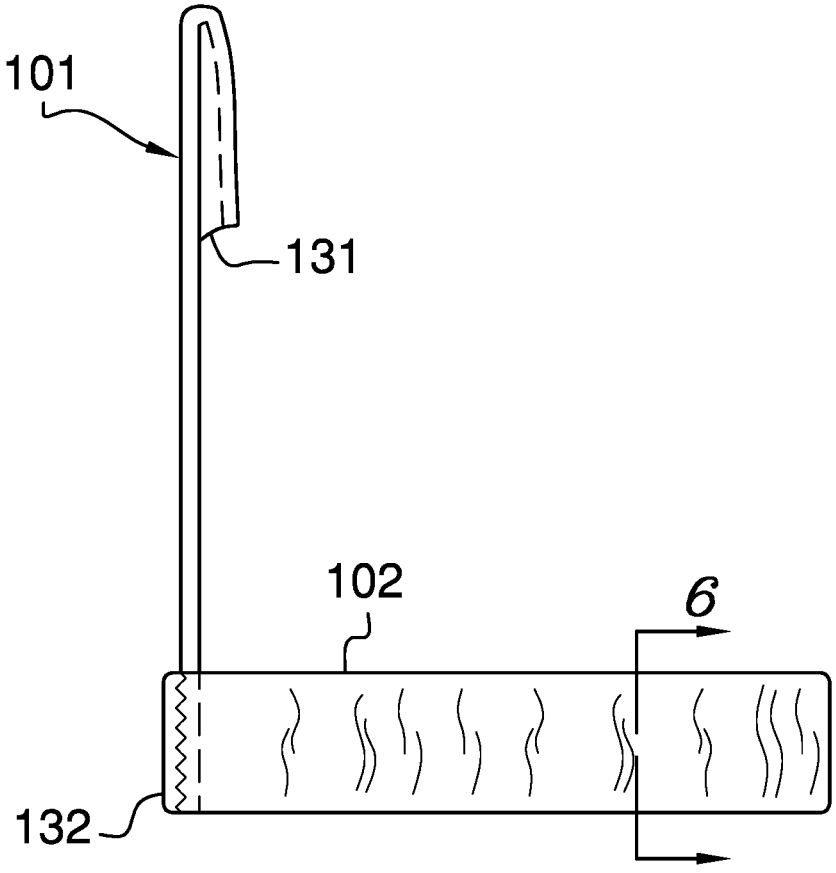
FIG. 4 is a side view of an embodiment of the disclosure.
Figure 5:
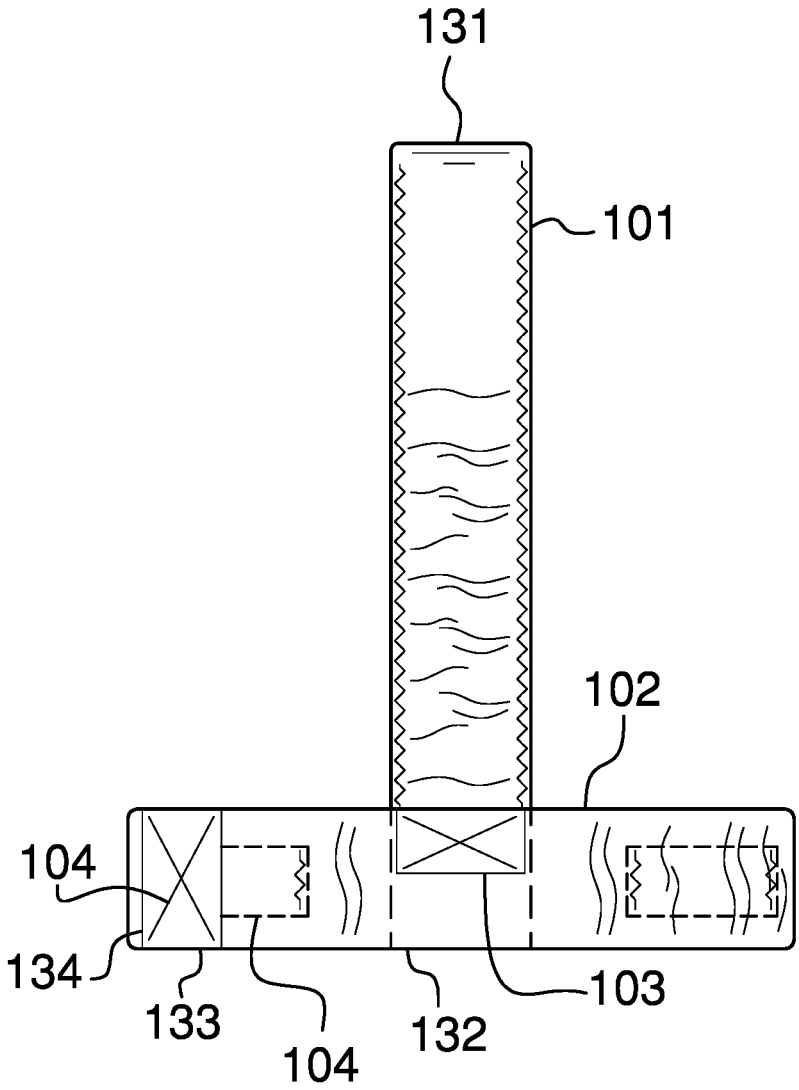
FIG. 5 is a rear view of an embodiment of the disclosure.
Figure 6:
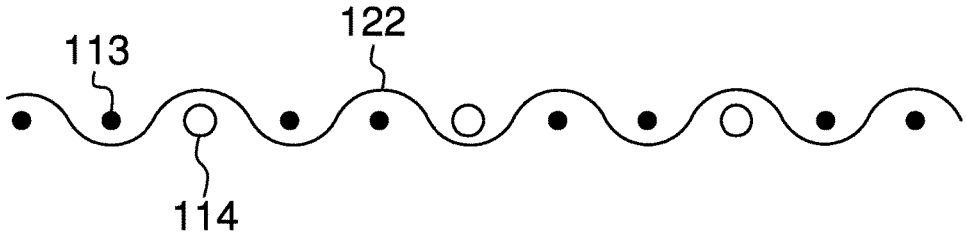
FIG. 6 is a cross-sectional view of an embodiment of the disclosure across 6-6 as shown in FIG. 4.
Figure 7:
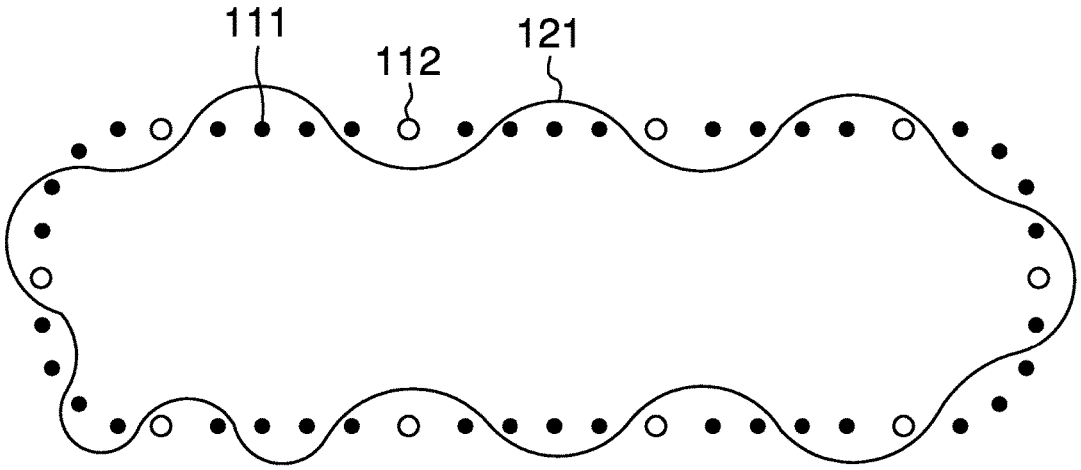
FIG. 7 is a cross-sectional view of an embodiment of the disclosure across 7-7 as shown in FIG. 2.

Detailed reference will now be made to one or more potential embodiments of the disclosure, which are illustrated in FIGS. 1 through 7.

The straw cover 100 (hereinafter invention) comprises a cover 101, a band 102, a first seam 103 and an optional second seam 104. The band 102 attaches the invention 100 to the beverage container 141. The cover 101 is placed over the drinking straw 142. The first seam 103 attaches the cover 101 to the band 102. The invention 100 is a device that attaches to a beverage container 141. The invention 100 is a protective cover 101 that can be placed over a drinking straw 142 that is placed within the beverage container 141. The cover 101 protects the drinking straw 142 while the contents 145 stored within the beverage container 141 are not being consumed.

The band 102 is an elastic webbing that further comprises a third plurality of warp yarns 113, a fourth plurality of warp yarns 114, and a second weft yarn 122. The band 102 is further defined with a third end 133 and a fourth end 134. The third plurality of warp yarns 113 comprises a collection of non-elastic yarns. Each of the third plurality of warp yarns 113 has the same denier (within normal manufacturing tolerances). It is preferred that the third plurality of warp yarns 113 be formed from a synthetic material such as nylon, polyester, or polypropylene. The use of nylon is preferred because it is easily dyed and easily printed upon.

The fourth plurality of warp yarns 114 comprises a collection of elastic yarns. Each of the fourth plurality of warp yarns 114 has the same denier (within normal manufacturing tolerances). The fourth plurality of warp yarns 114 be formed from a material that is selected from the group consisting of latex or elastane. Elastane is often referred to as spandex and is used in this disclosure to refer one of several different types of copolymer elastic yarns that generally are identified as "brands." The variations between the brands of elastane can be compensated through adjustments made to: 1) the manufacturing equipment; 2) the third plurality of warp yarns 113; or, 3) the second weft yarn 122. These adjustment techniques are well known by those skilled in the textile arts.

The second weft yarn 122 is a non-elastic yarn. It is preferred that the second weft yarn 122 be formed from a synthetic material such as nylon, polyester, or polypropylene. The use of nylon is preferred because it is easily dyed and easily printed upon.

In the first potential embodiment of the disclosure, the band 102 is formed as a woven elastic webbing using a plain 2 by 2 weave pattern. The fourth plurality of warp yarns 114 are placed under tension while the band 102 is being woven. As the fourth plurality of warp yarns 114 return to their relaxed shapes after weaving, the band 102 itself shrinks in length thereby giving the band 102 elasticity.

To form the band 102, the band 102 is cut to a predetermined length. The second seam 104 attaches the third end 133 to the fourth end 134.

The cut length of the band 102 is selected such that the band 102 must be stretched as it is put around the beverage container 141. After being looped around the beverage container 141, the band 102 attempts to return to its relaxed shape but is inhibited by the beverage container 141. The fourth plurality of warp yarns 114 and the tension placed upon the fourth plurality of warp yarns 114 fabrication weaving are selected such that the modulus of the band 102 is sufficient to hold the band 102 securely in place around the beverage container 141. Methods to design bands as described in this disclosure are well known and documented in the textile arts and especially in the narrow fabric arts. Bands as described in this disclosure are commercially available.

The cover 101 is a tubular textile that further comprises a first plurality of warp yarns 111, a second plurality of warp yarns 112, and a first weft yarn 121. The cover 101 is further defined with a first end 131 and a second end 132. The first plurality of warp yarns 111 comprises a collection of non-elastic yarns. Each of the first plurality of warp yarns 111 has the same denier (within normal manufacturing tolerances). It is preferred that the first plurality of warp yarns 111 be formed from a synthetic material such as nylon, polyester, or polypropylene. The use of nylon is preferred because it is easily dyed and easily printed upon.

The second plurality of warp yarns 112 comprises a collection of elastic yarns. Each of the second plurality of warp yarns 112 has the same denier (within normal manufacturing tolerances). The second plurality of warp yarns 112 is formed from a material that is selected from the group consisting of latex or elastane. Elastane is often referred to as spandex and is used in this disclosure to refer one of several different types of copolymer elastic yarns that generally are identified as "brands." The variations between the brands of elastane can be compensated through adjustments made to: 1) the manufacturing equipment; 2) the first plurality of warp yarns 111; or, 3) the first weft yarn 121. These adjustment techniques are well known by those skilled in the textile arts. It is preferred that an elastane be used to form the second plurality of warp yarns 112 to avoid the potential issues associated with latex allergies.

In the first potential embodiment of the disclosure, the first weft yarn 121 is a non-elastic yarn. It is preferred that the first weft yarn 121 be formed from a synthetic material such as nylon, polyester, or polypropylene. The use of nylon is preferred because it is easily dyed and easily printed upon.

In the first potential embodiment of the disclosure, the cover 101 is formed as a woven narrow fabric elastic webbing using a tubular weave pattern (also referred to as a 3 by 1 weave pattern). The second plurality of warp yarns 112 are placed under tension while the cover 101 is being woven. As the second plurality of warp yarns 112 return to their relaxed shapes after weaving, the cover 101 itself shrinks in length thereby giving the cover 101 elasticity. Methods to design tubular textiles as described in this disclosure are well known and documented in the textile, and especially in the narrow fabric, arts. Tubular textiles as described in this disclosure are commercially available.

To form the cover 101, the cover 101 is cut to a predetermined length. The first seam 103 attaches the second end 132 to the body of the band 102. In the first potential embodiment of the disclosure, the performance of the invention 100 is less sensitive to the cut length and the modulus of the cover 101 than it is to the cut length and the modulus of the band 102.

In the second potential embodiment of the disclosure, the first weft yarn 121 is an elastic yarn. It is preferred that the first weft yarn 121 be formed from an elastane yarn for reasons described elsewhere in this disclosure. The first weft yarn 121 is placed under tension while the cover 101 is being woven. As the first weft yarn 121 returns to its relaxed shape after weaving, the span of the inner diameter 151 of the tubular textile that forms the cover 101 shrinks in length thereby giving the inner diameter 151 of the cover 101 elasticity. In this scenario, the first weft yarn 121 and the tension placed upon the first weft yarn 121 during weaving are selected such that the modulus of the cover 101 is sufficient to hold the cover 101 securely to the drinking straw 142.

In a third potential embodiment of the disclosure, the second end 132, the third end 133, and the fourth end 134 are sewn together using a single first seam 103.

The following definitions were used in this disclosure:

Band: As used in this disclosure, a band is a flat loop of material.

Denier: As used in this disclosure, the term denier is a unit of weight that can be used to describe the fineness of a nylon, polyester yarn, rayon, or silk yarn that is calculated in as grams per 9000 meters.

Elastic: As used in this disclosure, an elastic is a material or object that deforms when a force is applied to it and that is able to return to its original shape after the force is removed. A material that exhibits these qualities is also referred to as an elastomeric material.

Elastic band: As used in this disclosure, an elastic band is a loop of textile that is formed using elastic material that can stretched. Alternatively, the elastic band can be a sheeting that is formed from latex, spandex, or an elastic plastic film that can be stretched.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Modulus: As used in this disclosure, the modulus of an elastic textile or elastic sheeting is a function that describes the percentage change in the span of the elastic textile or elastic sheeting as a function of the force applied to the elastic textile or elastic sheeting. When comparing modulus, a larger modulus is taken to imply that an increase in force is required to get the same percentage change in the elastic textile or elastic sheeting.

Relaxed Shape: As used in this disclosure, a structure is considered to be in its relaxed state when no shear, strain, or torsional forces are being applied to the structure.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, or an ultrasonically bonded seam.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheath: As used in this disclosure, a sheath is a flexible material that is used to cover an object.

Strap: As used in this disclosure a strap is a strip of leather, cloth, or other flexible material, often with a buckle, that is used to fasten, secure, carry, or hold onto something.

Textile: As used in this disclosure, a textile is a material that is woven, knitted, braided or felted. Synonyms in common usage for this definition include fabric and cloth.

Tube: As used in this disclosure, a tube is a hollow cylindrical device that is used for transporting liquids and gases. In this disclosure, the terms inner diameter and outer diameter are used as they would be used by those skilled in the plumbing arts.

Tubular Textile: As used in this disclosure, a tubular textile is a textile that is woven, knitted, or braided into a seamless tube like shape. Within this disclosure, the tubular textile is a webbing.

Warp: As used in this disclosure, the warp is the set of lengthwise yarns that are held in tension on a frame or loom. Each individual warp thread in a fabric is called a warp end.

Webbing: As used in this disclosure, a webbing is strong, close woven, knitted, or braided textile that is used for straps or belting. As used in this disclosure, webbing is a fully formed material that is only cut to length for use. Webbing is not formed by cutting broader materials into strips.

Weft: As used in this disclosure, the weft is the yarn or yarns that are inserted over and under the warp yarns. In common usage, the weft may also be referred to as the filling yarn or filler.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An apparatus comprising:

a cover, a band, and a first seam;

wherein the band attaches the apparatus to a beverage container;

wherein the first seam attaches the cover to the band;

wherein the apparatus is a device that attaches to a beverage container;

wherein the cover is placed over a drinking straw;

wherein the cover is a tubular textile;

wherein the cover comprises a first plurality of warp yarns, a second plurality of warp yarns, and a first weft yarn;

wherein the first plurality of warp yarns, the second plurality of warp yarns, and the first weft yarn are assembled into the tubular textile using a process selected from the group consisting of a weaving process; a knitting process, or a braiding process;

wherein the cover is further defined with a first end and a second end;

wherein the tubular textile is an elastic tubular textile;

wherein the first plurality of warp yarns comprises a collection of non-elastic yarns;

wherein each of the first plurality of warp yarns has the same denier;

wherein the second plurality of warp yarns comprises a collection of elastic yarns;

wherein each of the second plurality of warp yarns has the same denier;

wherein the second plurality of warp yarns is formed from an elastane;

wherein the first weft yarn is formed from an elastane.

2. The apparatus according to claim 1 wherein the cover is formed as a woven narrow fabric elastic webbing using a tubular pattern;

wherein the second plurality of warp yarns are placed under tension while the cover is being fabricated.

3. The apparatus according to claim 2 wherein the band is an elastic webbing;

wherein the band further comprises a third plurality of warp yarns, a fourth plurality of warp yarns, and a second weft yarn;

wherein the third plurality of warp yarns, the fourth plurality of warp yarns, and the second weft yarn are assembled into the elastic webbing using a process selected from the group consisting of a weaving process; a knitting process, or a braiding process;

wherein the band is further defined with a third end and a fourth end.

4. The apparatus according to claim 3 wherein the third plurality of warp yarns comprises a collection of non-elastic yarns;

wherein each of the third plurality of warp yarns has the same denier.

5. The apparatus according to claim 4 wherein the fourth plurality of warp yarns comprises a collection of elastic yarns;

wherein each of the fourth plurality of warp yarns has the same denier;

wherein the fourth plurality of warp yarns be formed from a material that is selected from the group consisting of latex or elastane;

wherein the second weft yarn is a non-elastic yarn.

6. The apparatus according to claim 5 wherein the band is formed as a woven elastic webbing using a plain 2 by 2 weave pattern.

7. The apparatus according to claim 6 wherein the fourth plurality of warp yarns are placed under tension while the band is being fabricated.

8. The apparatus according to claim 7 wherein the band is cut to a predetermined length;

wherein the cut length of the band is selected such that the band stretches as the band is put around the beverage container;

wherein the first seam attaches the second end to the body to the third end of the band;

wherein the first seam attaches the second end to the body to the fourth end of the band.

9. The apparatus according to claim 7 wherein the band is cut to a predetermined length;

wherein the cut length of the band is selected such that the band stretches as the band is put around the beverage container;

wherein the apparatus further comprises a second seam;

wherein the first seam attaches the second end to the body of the band;

wherein the second seam attaches the third end to the fourth end.

10. The apparatus according to claim 1 wherein the cover is formed as a woven narrow fabric elastic webbing using a tubular pattern;

wherein the second plurality of warp yarns are placed under tension while the cover is being woven;

wherein the first weft yarn is placed under tension while the cover is being fabricated.

11. The apparatus according to claim 10 wherein the band is an elastic webbing;

wherein the band further comprises a third plurality of warp yarns, a fourth plurality of warp yarns, and a second weft yarn;

wherein the third plurality of warp yarns, the fourth plurality of warp yarns, and the second weft yarn are assembled into the elastic webbing using a process selected from the group consisting of a weaving process; a knitting process, or a braiding process;

wherein the band is further defined with a third end and a fourth end.

12. The apparatus according to claim 11 wherein the third plurality of warp yarns comprises a collection of non-elastic yarns;

wherein each of the third plurality of warp yarns has the same denier;

wherein the fourth plurality of warp yarns comprises a collection of elastic yarns;

wherein each of the fourth plurality of warp yarns has the same denier;

wherein the fourth plurality of warp yarns is formed from elastane;

wherein the second weft yarn is a non-elastic yarn;

wherein the band is formed as a woven elastic webbing using a plain 2 by 2 weave pattern;

wherein the fourth plurality of warp yarns are placed under tension while the band is being fabricated.

13. The apparatus according to claim 12 wherein the band is cut to a predetermined length;

wherein the cut length of the band is selected such that the band stretches as the band is put around the beverage container;

wherein the first seam attaches the second end to the body to the third end of the band;

wherein the first seam attaches the second end to the body to the fourth end of the band.

14. The apparatus according to claim 12 wherein the band is cut to a predetermined length;

wherein the cut length of the band is selected such that the band stretches as the band is put around the beverage container;

wherein the apparatus further comprises a second seam;

wherein the first seam attaches the second end to the body of the band;

wherein the second seam attaches the third end to the fourth end.

15. The apparatus according to claim 14 wherein each of the first plurality of warp yarns is nylon;

wherein each of the second plurality of warp yarns is elastane;

wherein each of the third plurality of warp yarns is nylon;

wherein the first weft yarn is nylon;

wherein the second weft yarn is nylon.

* * * * *